US007909625B2

(12) United States Patent
Obenshain

(10) Patent No.: US 7,909,625 B2
(45) Date of Patent: Mar. 22, 2011

(54) PLUG LOCKING ASSEMBLY AND SYSTEM

(75) Inventor: Marc R. Obenshain, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/876,864

(22) Filed: Sep. 7, 2010

(65) Prior Publication Data

US 2010/0330832 A1 Dec. 30, 2010

Related U.S. Application Data

(63) Continuation of application No. 12/147,599, filed on Jun. 27, 2008, now Pat. No. 7,806,706.

(60) Provisional application No. 60/947,831, filed on Jul. 3, 2007.

(51) Int. Cl.
*H01R 13/44* (2006.01)

(52) U.S. Cl. ..... 439/133; 439/304; 439/309

(58) Field of Classification Search ..... 439/133, 439/138, 304, 309
See application file for complete search history.

(56) References Cited

U.S. PATENT DOCUMENTS

| | | | | |
|---|---|---|---|---|
| 4,080,029 | A * | 3/1978 | St. Fort | 439/131 |
| 4,311,883 | A | 1/1982 | Kidney | |
| 4,647,726 | A | 3/1987 | Blum | |
| 4,740,168 | A | 4/1988 | Carney et al. | |
| 4,846,708 | A | 7/1989 | Marson et al. | |
| 4,870,840 | A | 10/1989 | Klein | |
| 4,964,284 | A | 10/1990 | McDaid | |
| 5,090,916 | A | 2/1992 | Magnier | |
| 5,190,465 | A | 3/1993 | Davidge et al. | |
| 5,220,815 | A | 6/1993 | Davidge et al. | |
| 5,288,241 | A | 2/1994 | Davidge et al. | |
| 5,305,380 | A | 4/1994 | Hileman et al. | |
| 5,340,324 | A | 8/1994 | Fields et al. | |
| 5,420,951 | A | 5/1995 | Marazzi et al. | |
| 5,429,522 | A | 7/1995 | Noschese et al. | |
| 5,556,295 | A | 9/1996 | McFadden et al. | |
| 5,637,002 | A | 6/1997 | Buck et al. | |
| 5,984,705 | A | 11/1999 | Miyazaki et al. | |
| 6,080,001 | A | 6/2000 | Wong | |
| 6,851,957 | B1 | 2/2005 | Bhogal et al. | |
| 6,863,556 | B2 | 3/2005 | Viklund et al. | |
| 6,896,535 | B2 | 5/2005 | Yamada et al. | |
| 7,037,129 | B2 | 5/2006 | Lo et al. | |

(Continued)

FOREIGN PATENT DOCUMENTS

| | | | |
|---|---|---|---|
| EP | 1762871 | A1 | 3/2007 |
| WO | 02075859 | A1 | 9/2002 |
| WO | 2007016794 | A1 | 2/2007 |

*Primary Examiner* — James Harvey

(74) *Attorney, Agent, or Firm* — Robert A. McCann; Christopher S. Clancy

(57) ABSTRACT

A system comprises a plug locking assembly and a key. The plug locking assembly comprises a cover for receiving and holding a plug comprising a latch and a latch support surface positionable under the latch. A rotatable cam comprising a stop surface and a slot may carry the latch support surface and may interact with a cam latch comprising an arm. The arm is alternately positionable to abut the stop surface and to lie within the slot. The key may comprise a shaft, a key tab and a limit tab. The key mates with a key receiving member associated with the cover. The limit tab is positioned on a top surface of the shaft and helps prevent over-rotation of the latch support member.

14 Claims, 10 Drawing Sheets

U.S. PATENT DOCUMENTS

| | | | |
|---|---|---|---|
| 7,101,212 | B1 | 9/2006 | Larkin |
| 7,204,721 | B2 | 4/2007 | Lundholm et al. |
| 7,297,013 | B2 | 11/2007 | Caveney et al. |
| 7,354,291 | B2 | 4/2008 | Caveney et al. |
| 7,465,180 | B2 | 12/2008 | Kusuda et al. |
| 2006/0025003 | A1 | 2/2006 | Liao |

* cited by examiner

PLUG LOCKING ASSEMBLY AND SYSTEM

CROSS REFERENCE TO RELATED APPLICATIONS

This application is a continuation of U.S. patent application Ser. No. 12/147,599, filed Jun. 27, 2008, which claims the benefit of U.S. Provisional Application Ser. No. 60/947,831, filed Jul. 3, 2007, the subject matter of which is hereby incorporated by reference in its entirety.

FIELD OF THE INVENTION

This invention relates to a plug locking assembly and, more particularly, to a plug locking assembly comprising a cover and a securement feature for locking a plug into position within a jack. The invention also relates to a system comprising a plug locking assembly and a key for manipulating the plug locking assembly.

BACKGROUND

Modular connections often rely on the use of plugs secured within jacks. The plugs typically comprise a latch that secures the plug within the jack. The latch may be depressed to disengage the plug for easy removal from the jack, allowing disconnection of a device from a network without using tools. In some cases, the latch may be accidentally depressed or unauthorized users may tamper with the latch, resulting in unwanted removal of the plug from the jack.

There is a need, therefore, to protect plugs and prevent their unintended disconnection from associated jacks.

SUMMARY OF THE INVENTION

The present invention is directed to an improved plug locking assembly and a system for securing a plug comprising a latch into position, the system comprising a plug locking assembly and a key.

In one aspect, a plug locking assembly comprises a cover and a latch support surface associated with the cover. The cover comprises an opening for receiving and holding a plug comprising a latch. The latch support surface is positionable to underlie the latch of the plug when the plug is positioned within the opening of the cover, thereby resisting depression of the latch.

In one embodiment, the plug locking assembly may comprise a cover comprising an opening for receiving and holding a plug comprising a latch and a rotatable cam associated with the cover. The rotatable cam of this embodiment comprises a latch support surface positionable to underlie the latch of the plug when the plug is positioned within the opening of the cover and the latch support surface resists depression of the latch when the latch support surface underlies the latch.

In another embodiment, the plug locking assembly may comprise a cover comprising an opening for receiving and holding a plug comprising a latch, a cam associated with the cover and a cam latch. The cam may comprise a latch support surface, a stop surface and a slot. The latch support surface resists depression of the latch when the latch support surface underlies the latch. The cam latch comprises an arm alternatively positionable in a first position abutting the stop surface of the cam to prevent movement of the cam and a second position lying within the slot of the cam to allow movement of the cam.

The plug locking assembly may comprise various other features. The cover may comprise a key receiving member for receiving a key to change the position of the latch support surface. This key receiving member may comprise a stop surface for preventing over-rotation of the key. Likewise, the cover may comprise a stop surface to prevent movement of the latch support surface in a predetermined direction. The latch support surface may be substantially planar and positioned on a rotatable cam comprising a curvilinear surface. The latch support surface may be alternatively disposed in a first position spaced apart from the latch and a second position underlying a bottom surface of the latch and in contact therewith. The rotatable cam may further comprise a slot for receiving an arm of the cam latch to allow movement of the cam. Additionally, at least one of the rotatable cam and the cam latch may further comprise a retention tab to engage a slot positioned within the cover.

In another aspect of the invention, a system for securing a plug comprising a latch in position comprises a cover comprising an opening for receiving and holding the plug, a latch support member associated with the cover and a key comprising a shaft, a key tab and a limit tab. The cover also comprises a key receiving member for receiving a key. The latch support member prevents substantial movement of the latch with the plug positioned within the cover. The key tab of the key is designed for mating with the key receiving member and the limit tab is positioned on a top surface of the shaft to prevent over-rotation of the latch support member.

The system may also comprise additional features. The key tab may be positioned at one end of the key and extend from a first end to a second end with a curvilinear surface connecting the first and second ends. The shaft of the key may be hollow and comprise an internal projection for engaging the key. The limit tab may comprise an angled surface. The key receiving member may comprise a key retention lip for securing the key in the key receiving member. The key receiving member may also comprise one or more limit stops and a key tab slot for receiving the key tab. In addition, all of the elements of the plug locking assembly, including a rotatable cam and a cam latch may be incorporated into the system.

DETAILED DESCRIPTION OF THE INVENTION

Figure 1:
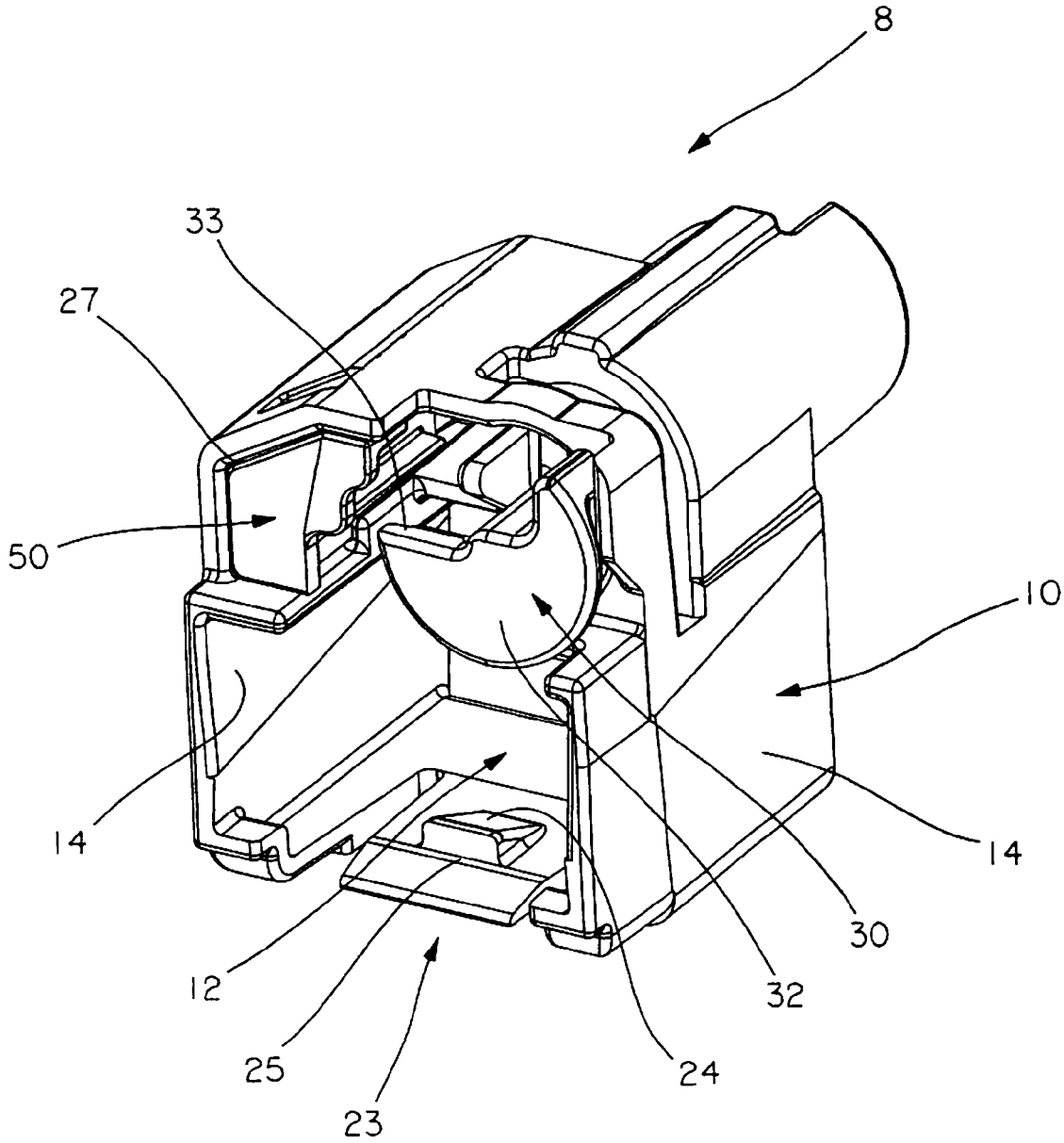
FIG. 1 is a perspective view of one embodiment of the plug locking assembly of the present invention.
Figure 2:
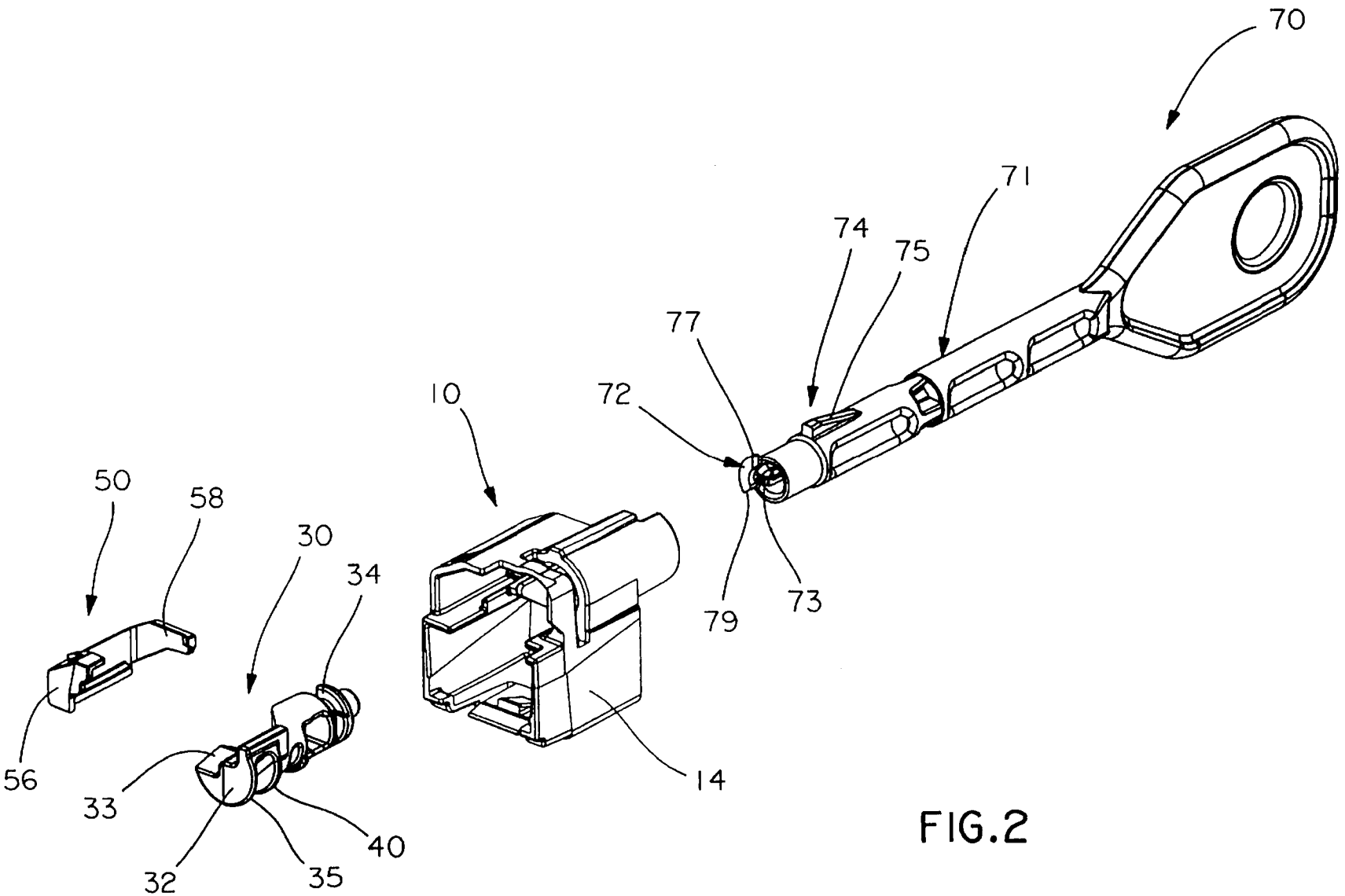
FIG. 2 is an exploded view of FIG. 1 shown with a key used in connection therewith.

Referring to FIGS. 1-6, plug locking assembly 8 of the present invention comprises cover 10, cam 30 and cam latch 50. Locking assembly 8 may be used in connection with key 70 for rotating cam 30. The foregoing components may be made of a variety of materials, including metal and plastic, and may be constructed by methods known to those skilled in the art, including machining and injection molding.

Figure 3:
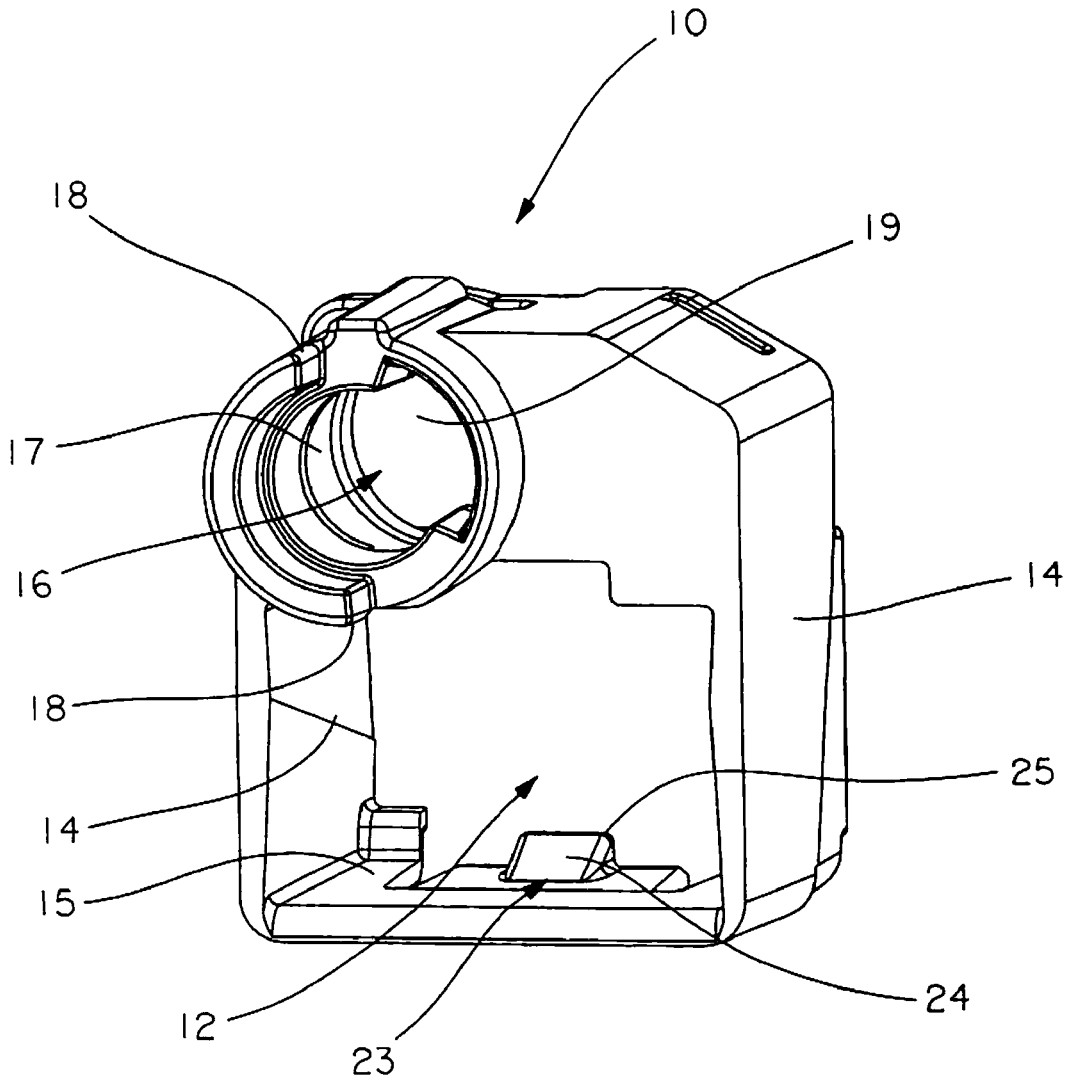
FIG. 3 is a perspective rear view of the cover of FIG. 1.
Figure 7A:
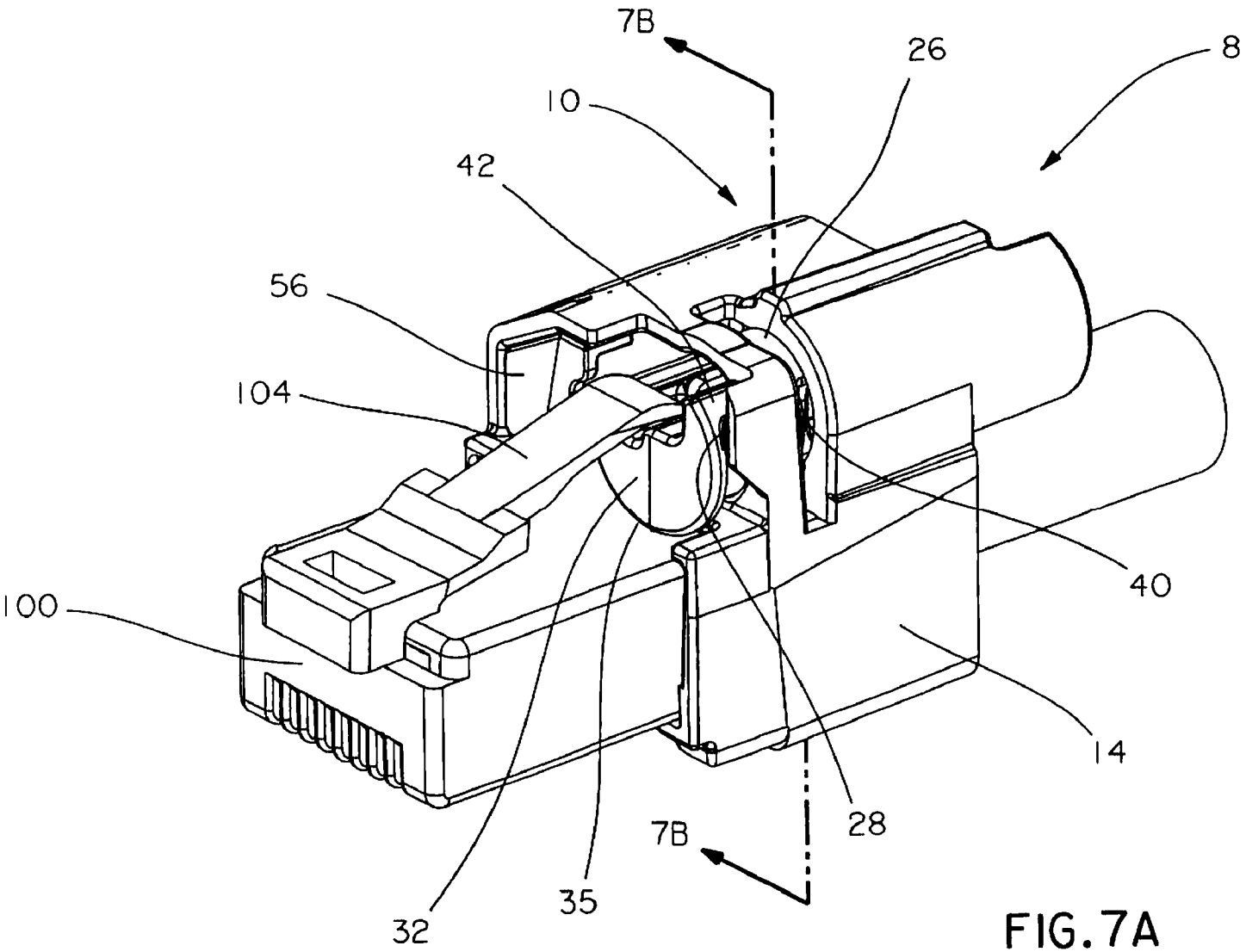
FIG. 7A is a perspective view of FIG. 1 with a plug installed within the plug locking assembly.
Figure 7B:
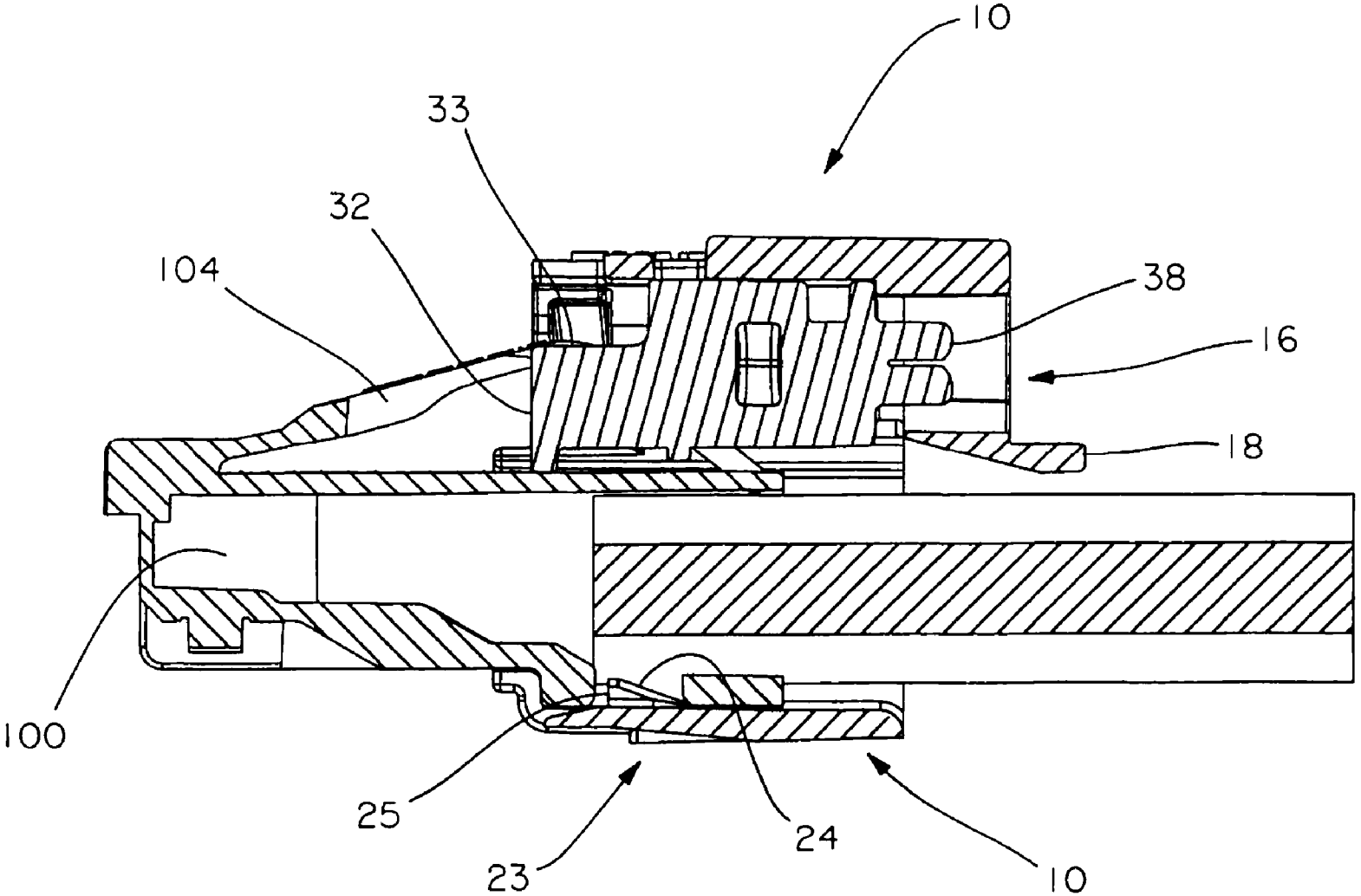
FIG. 7B is a cross section of FIG. 7A through the axis of rotation of the cam.
Figure 8:
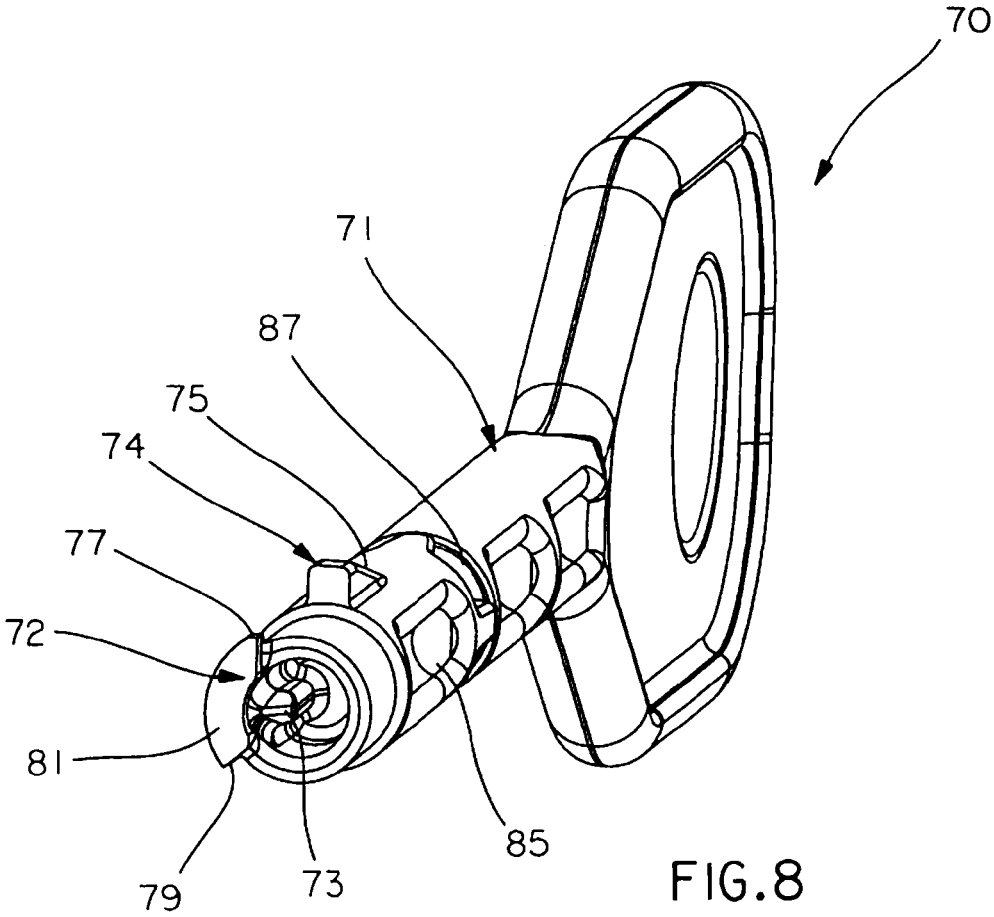
FIG. 8 is a perspective view of the key of FIG. 2.

Referring now to FIGS. 3 and 7A, cover 10 comprises opening 12, sized and shaped for receipt of a plug, opposing sidewalls 14, internal bottom surface 15, key receiving member 16 for receiving key 70, cam retention slot 26 (shown in FIG. 7A) and side stop surface 28 (also shown in FIG. 7A). Internal bottom surface 15 may comprise retaining latch 23, defined by inclined surface 24 and front stop surface 25. Retaining latch 23 secures the plug within cover 10. Key receiving member 16 may further comprise key retention lip 17, limit stops 18 and key tab slot 19. Key retention lip 17 helps secure key 70 in key receiving member 16 during rotation of key 70. Limit stops 18 prevent movement of latch support surface 33 in a predetermined direction (including e.g., over-rotation), and key tab slot 19 receives key tab 72 of key 70, as shown in FIGS. 3 and 8. As best seen in FIGS. 3 and 7A, respectively, cover 10 may further comprise cam retention slot 26 for receiving and holding cam 30. Side stop surface 28 of cover 10 prevents rotation of cam 30 in a clockwise direction. As best seen in FIG. 1, cover 10 may also comprise notched portion 27 to provide clearance for certain features used in VOIP phones.

Figure 4A:
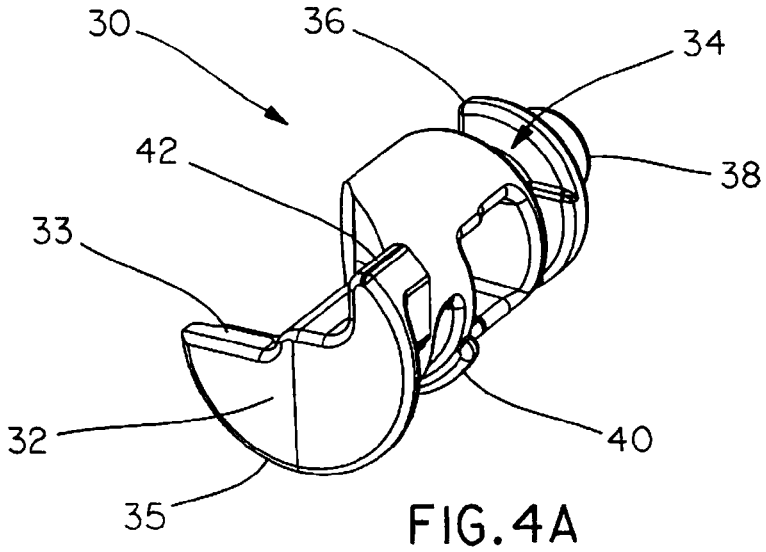
FIG. 4A is a perspective view of one embodiment of the cam component of FIG. 1.
Figure 4B:
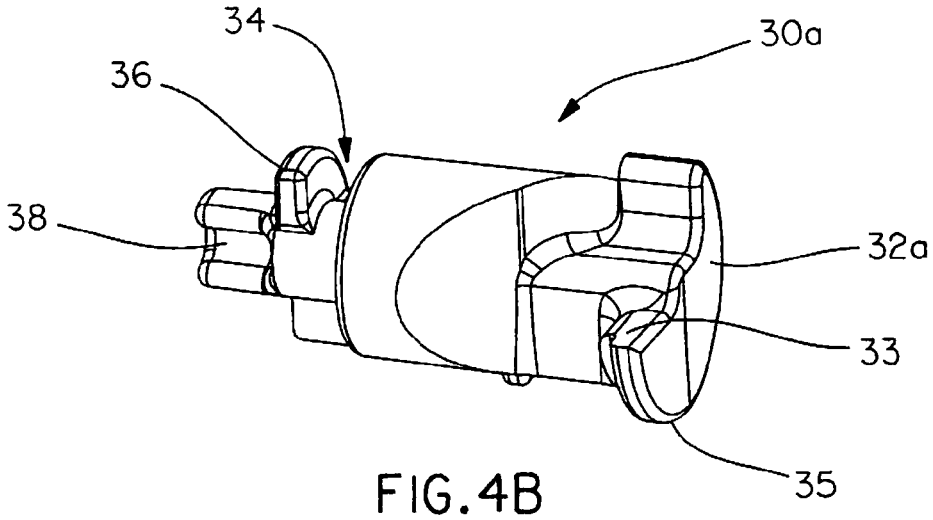
FIG. 4B is a side elevated view of FIG. 4A.
Figure 4C:
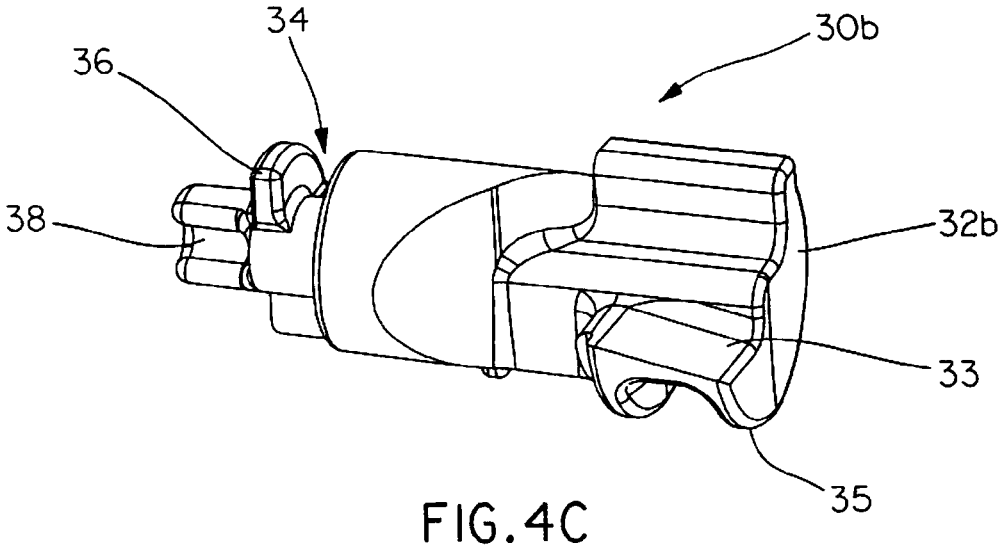
FIG. 4C is a side elevated view of an alternate embodiment of FIG. 4A.

FIGS. 4A-C illustrate details of rotatable cam 30, designed to assist in preventing depression of the latch of a plug positioned within cover 10. Cam 30 may comprise different lengths. Short cam 30*a*, shown in FIG. 4B, comprises a relatively short plug latch support 32*a*, designed for receptacles that are recessed behind a panel or frame that obstructs the area into which the cam would reach. The dimensions of short cam 30*a* may be about 0.45 inches in length. Long cam 30*b*, shown in FIG. 4C, has a relatively thick plug latch support 32*b*, designed for use with receptacles that are flush or very near the face of the panel in which they are mounted. The longer plug latch support 32*b* provides extra support, which is desirable given the longer space between the center of gravity of plug locking assembly 8 and the face of the receptacle. The dimensions of long cam 30*b* may be about 0.58 inches in length.

Figure 6:
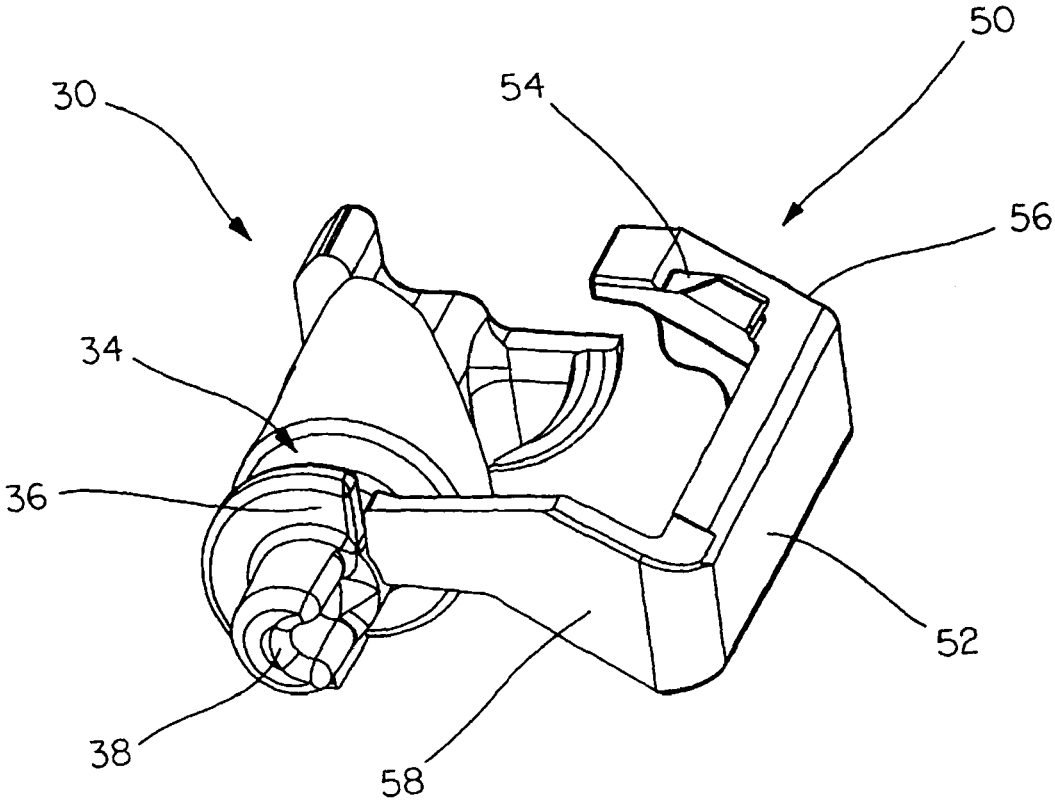
FIG. 6 is a perspective view of the cam and cam latch components of FIGS. 4C and 5 in an assembled state.

Cam 30 typically comprises plug latch support 32, slot 34, cam latch stop 36, keyway 38, retention tab 40 and rotation stop 42. Plug latch support 32 may comprise latch support surface 33 connected to curvilinear surface 35, which extends to rotation stop 42. Although plug latch support 32 is shown with a curvilinear surface, it may exhibit other shapes, such as rectangular. Latch support surface 33 is typically substantially planar. Cam latch stop 36 and rotation stop 42 prevent unwanted rotation of cam 30. As best seen in FIG. 6, cam latch stop 36 prevents rotation of cam 30 when key 70 is not inserted into keyway 38, through its interaction with cam latch 50. Cam 30 may rotate freely with key 70 inserted into keyway 38, because key 70 causes a portion of cam latch 50 to slide into slot 34. As shown in FIGS. 7A and B, rotation stop 42 abuts side stop surface 28 of cover 10, preventing rotation of cam 30 in a clockwise direction. To engage cam 30 within cover 10, retention tab 40 engages cam retention slot 26 of cover 10, as shown in FIG. 7A. Under these circumstances, cam 30 is secured within cover 10 in alignment with key receiving member 16.

Figure 5:
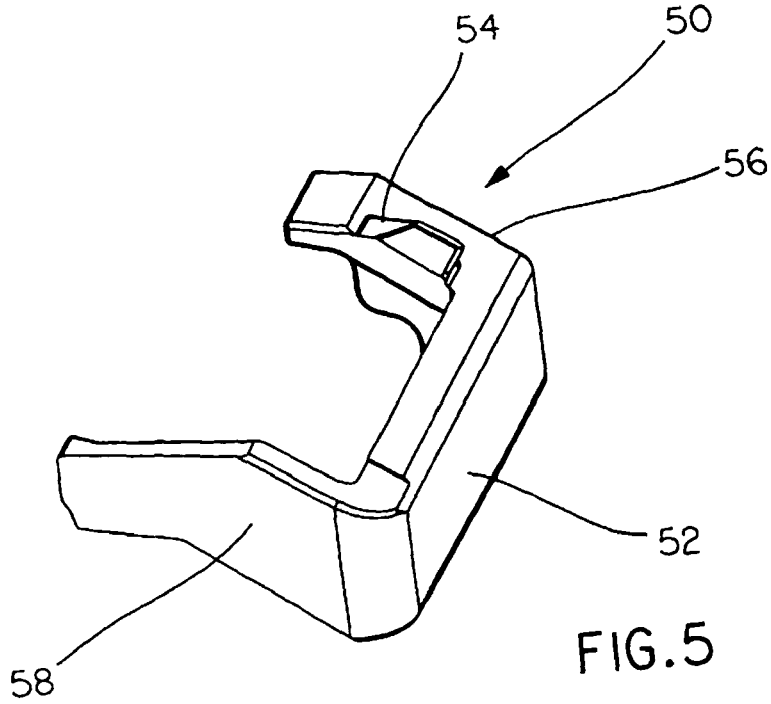
FIG. 5 is a perspective view of the cam latch component of FIG. 1.

FIG. 5 illustrates a detail of cam latch 50, which includes sidewall 52, retention tab 54, front surface 56, and latch arm 58. Cam latch 50 is secured to cover 10 through engagement of retention tab 54 within a slot (not shown) defined within cover 10. With cam latch 50 secured within cover 10, front surface 56 precludes access to retention tab 54. As previously mentioned, latch arm 58 engages stop 36 of cam 30 when key 70 is not engaged within key receiving member 16 and keyway 38, thereby preventing rotation of cam 30 and holding plug latch support 32 in place. FIG. 6 illustrates the relationship between cam 30 and cam latch 50, when both are positioned within cover 10.

FIG. 8 illustrates key 70, designed to rotate cam 30 and lock/unlock plug locking assembly 8. Key 70 includes shaft 71, key tab 72 and limit tab 74. Shaft 71 may be hollow and comprise internal projection 73 for mating with keyway 38. Key tab 72 is dimensioned and shaped to mate with key tab slot 19 of key receiving member 16 of cover 10. Key tab 72 may extend from first end 77 to second end 79 through curvilinear surface 81. Key 70 also prevents cam 30 from over-rotation through limit tab 74, which prevents rotation of key 70 when it strikes limit stops 18 of cover 10. Limit tab 74 may be positioned on a top surface of shaft 71 and comprise angled surface 75. Key 70 may further comprise core outs 85 for ease of manufacture and key break 87 to provide a break point for key 70 when severe over-rotation of key occurs.

Figure 10:
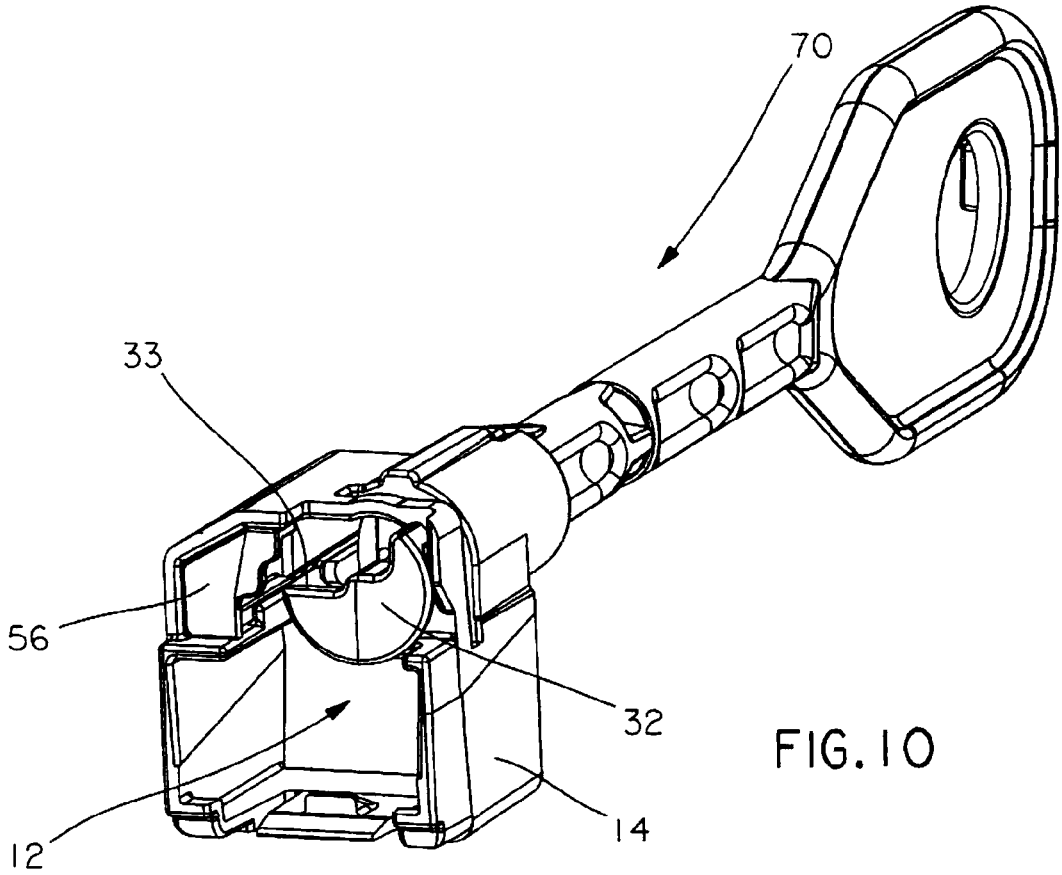
FIG. 10 is a front perspective view of FIG. 1, shown with the tool of FIG. 2 and the cam component of FIG. 4A disposed in a first position.
Figure 11:
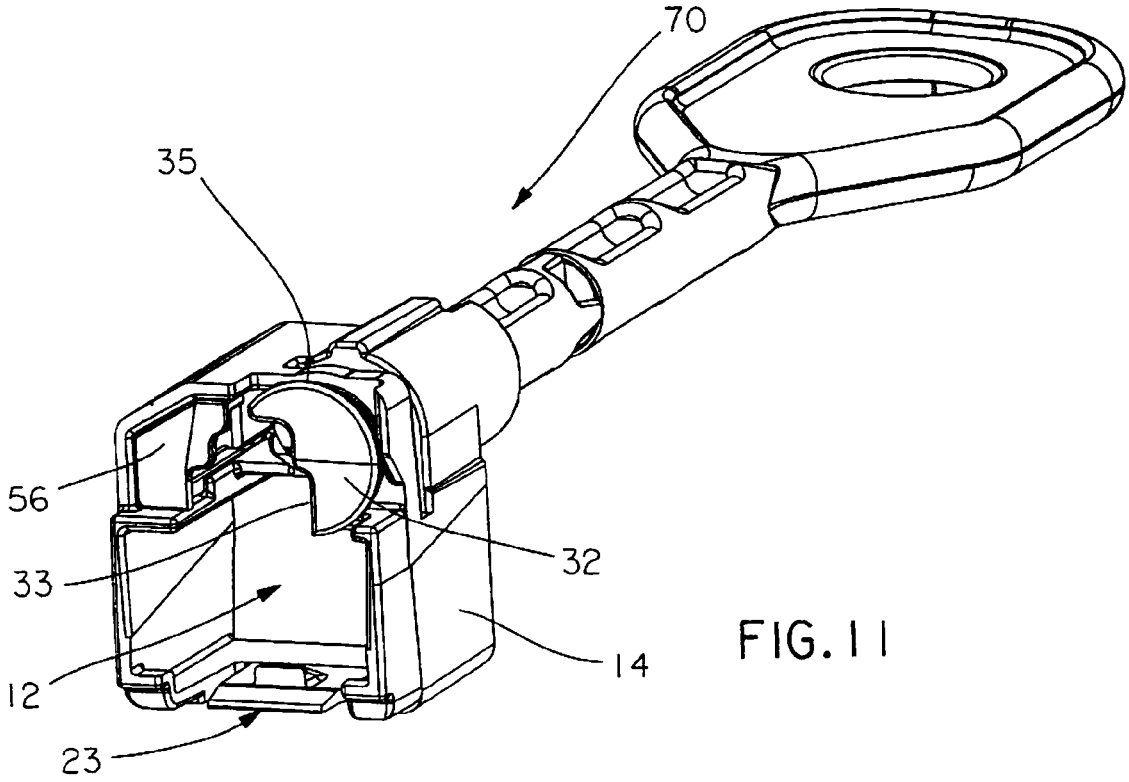
FIG. 11 is front perspective view of FIG. 10, with the cam component disposed in a second position.
Figure 12:
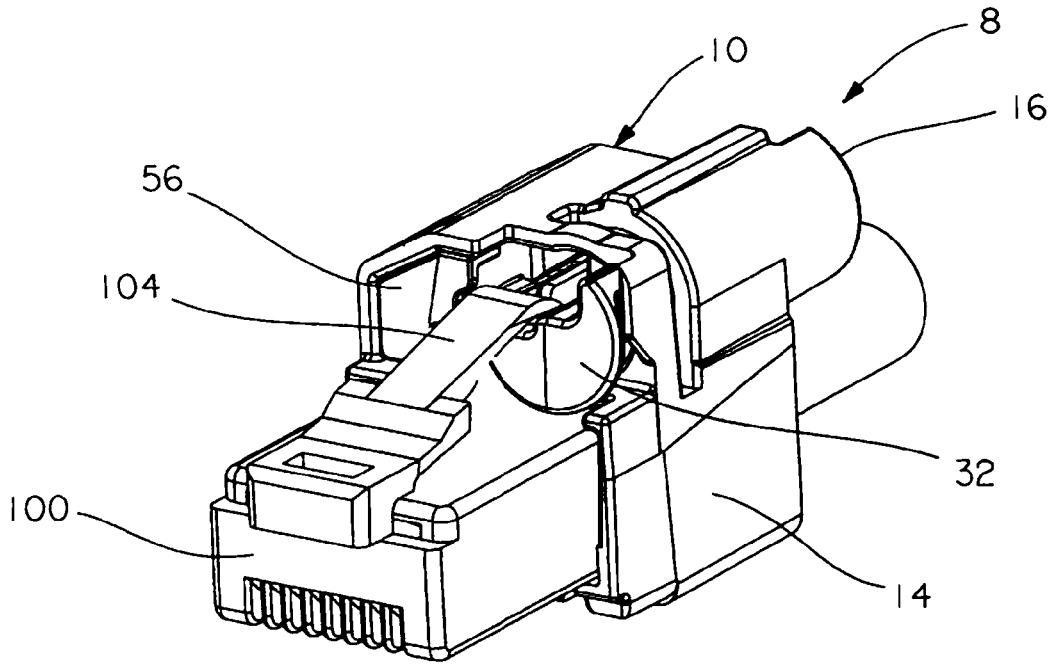
FIG. 12 is a front perspective view of FIG. 1, shown with a plug in a locked position.
Figure 13:
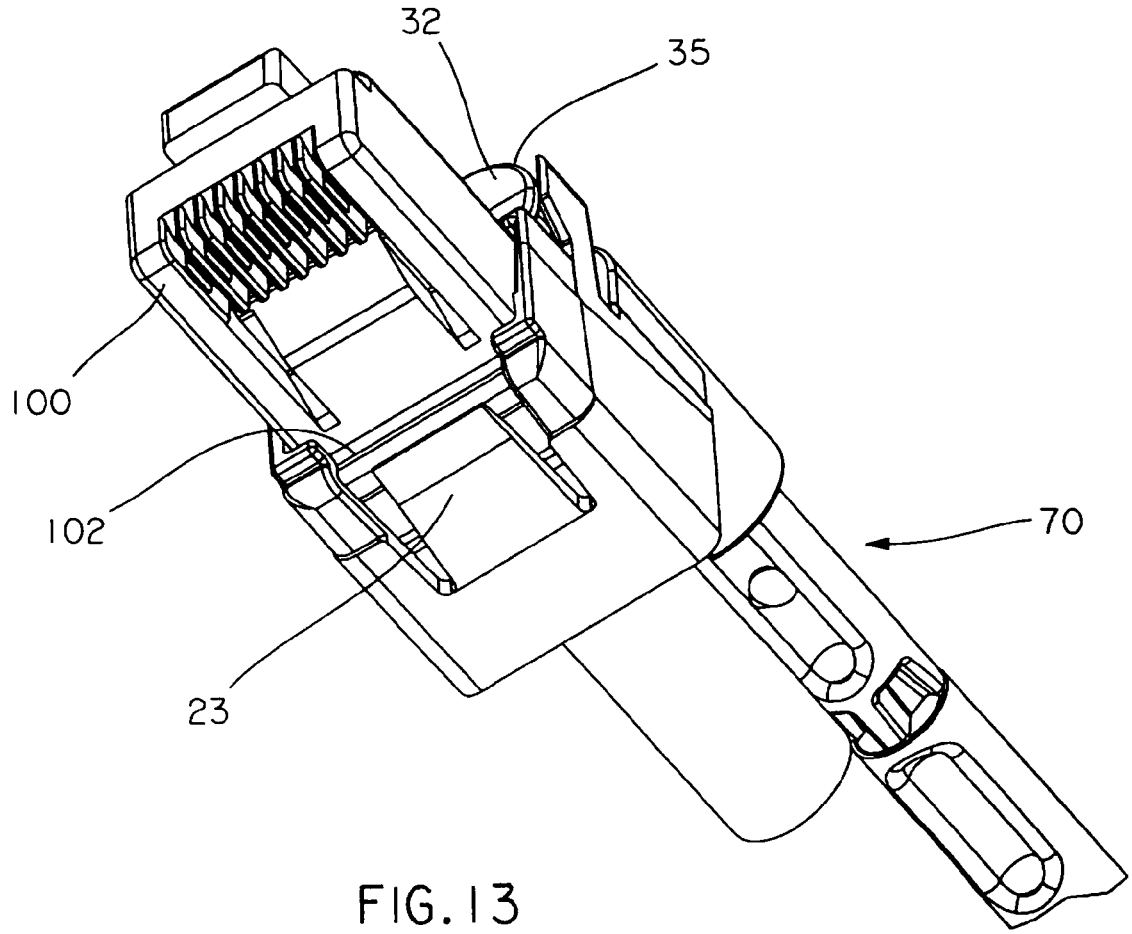
FIG. 13 is a bottom perspective view of FIG. 12.

FIGS. 10-12 illustrate stepwise operation of plug locking assembly 8.

Figure 9:
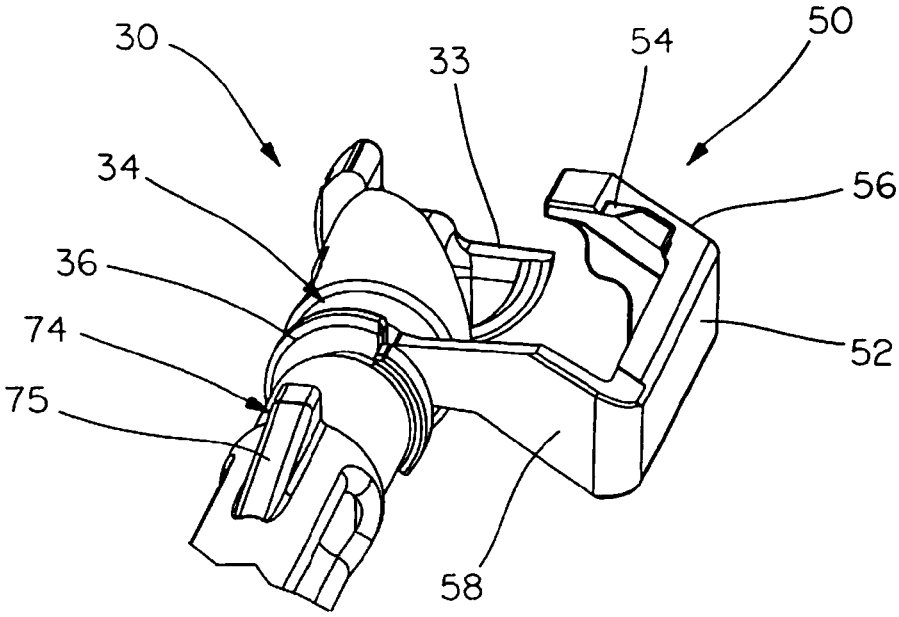
FIG. 9 is a perspective view of the key of FIG. 2 engaged within the cam assembly of FIG. 6.

Securement of plug 100 within a jack (not shown) through plug locking assembly 8 is relatively straightforward. Key 70 is inserted into key receiving member 16 of cover 10, followed by rotation in a counterclockwise direction by about 90 degrees. When key 70 is inserted into key receiving member 16 of cover 10, it also engages keyway 38 of cam 30, which causes key tab 72 to push latch arm 58 out of contact with stop surface 36 and into slot 34, as shown in FIG. 9-11. Thus, as key 70 rotates in a counterclockwise direction, cam 30 also rotates in a counterclockwise direction, clearing opening 12 for receipt of plug 100 and positioning latch support surface 33 transverse to internal bottom surface 15 of cover 10, as shown in FIG. 10.

Plug 100 may then be secured within opening 12. When plug 100 is inserted into opening 12, plug rides over inclined surface 24 and retaining latch 23 comes to rest in slot 102 of plug 100.

Insertion of plug 100 into a jack may occur next. With plug 100 engaged within jack, key 70 may be rotated in a clockwise direction, such that plug latch support surface 33 underlies and contacts latch 104 to secure latch 104 into position and help prevent accidental or unauthorized depression of latch 104 as shown in FIGS. 11 and 12. Key 70 may then be removed from key receiving member 16, leaving plug latch 104 engaged with plug latch support 32 and allowing latch arm 58 of cam latch 50 to once again abut cam latch stop 36 of cam 30. In this way, locking assembly 8 secures plug 100 within jack.

Removal of plug 100 from jack is also possible. With plug 100 engaged within jack, key 70 is once again inserted into key receiving member 16 of cover 10 and keyway 38 of cam 30. Rotation of cam 30 in a counterclockwise direction frees plug latch support member 32 from its position beneath latch 104 of plug 100. Plug latch 104 may then be depressed, followed by removal of plug 100 from jack. Plug locking assembly 8 may then be removed from plug 100 by manually removing retaining latch 23 from slot 102 and pressing plug 100 out by hand.

While certain embodiments of the present invention have been shown and described, it will be obvious to those skilled in the art that changes and modifications may be made without departing from the spirit and scope of the invention. The matter set forth in the foregoing description and accompanying drawings is offered by way of illustration only and not as a limitation. The actual scope of the invention is intended to be defined in the following claims.

The invention claimed is:

1. A plug locking assembly comprising:

a cover comprising an opening for receiving and holding a plug comprising a latch;

a rotatable cam, at least a portion of which is positionable to underlie said latch; and a cam latch for releasably engaging said rotatable cam to alternatively substantially prevent and permit rotation of said cam.

2. The plug locking assembly of claim 1, wherein said cover comprises a key receiving member for receiving a key to rotate said rotatable cam.

3. The plug locking assembly of claim 1, wherein said rotatable cam is rotatable about an axis extending in an insertion direction of said plug.

4. The plug locking assembly of claim 1, wherein said cam is rotatable between a first position to permit insertion of said plug into said cover and a second position to prevent insertion of said plug into said cover.

5. The plug locking assembly of claim 1, wherein at least one of said cam, said cam latch and said cover comprises a stop surface to prevent over rotation of said cam.

6. The plug locking assembly of claim 1, wherein at least one of said cam and said cam latch comprises a retention tab to releasably secure said at least one of said cam and said cam latch to said cover.

7. The plug locking assembly of claim 1, wherein said rotatable cam comprises a slot for receiving a portion of said cam latch to permit rotation of said cam.

8. A plug locking assembly comprising:

a cover comprising an opening for receiving and holding a plug comprising a latch;

a cam comprising a substantially cylindrical portion and a substantially planar surface, said substantially planar surface positionable to underlie said latch; and a cam latch to prevent movement of said cam when said substantially planar surface underlies said latch.

9. The plug locking assembly of claim 8, wherein said cover comprises a key receiving member for receiving a key to move said cam.

10. The plug locking assembly of claim 8, wherein said cam is rotatable about an axis extending in an insertion direction of said plug.

11. The plug locking assembly of claim 8, wherein said cam is movable between a first position to permit insertion of said plug into said cover and a second position to prevent insertion of said plug into said cover.

12. The plug locking assembly of claim 8, wherein at least one of said cam, said cam latch and said cover comprises a stop surface to prevent movement of said cam in a predetermined direction.

13. The plug locking assembly of claim 1, wherein at least one of said cam and said cam latch comprises a retention tab to releasably secure said at least one of said cam and said cam latch to said cover.

14. The plug locking assembly of claim 1, wherein said cam comprises a slot for receiving a portion of said cam latch to permit movement of said cam.

* * * * *